US005952067A

United States Patent [19]

Head

[11] Patent Number: 5,952,067

[45] Date of Patent: Sep. 14, 1999

[54] BRAIDED STRUCTURE HAVING UNCRIMPED STRANDS

[75] Inventor: Andrew A. Head, Indian Hill, Ohio

[73] Assignee: A&P Technology, Inc., Covington, Ky.

[21] Appl. No.: 08/942,603

[22] Filed: Oct. 2, 1997

Related U.S. Application Data

[63] Continuation-in-part of application No. 08/759,732, Dec. 6, 1996

[60] Provisional application No. 60/032,230, Dec. 2, 1996.

[51] Int. Cl.[6] ..... D04C 1/00

[52] U.S. Cl. ..... 428/36.3; 428/36.91; 87/9

[58] Field of Search ..... 428/36.3, 36.91; 87/9

[56] References Cited

U.S. PATENT DOCUMENTS

| | | | |
|---|---|---|---|
| 2,580,436 | 1/1952 | Knoblaugh . | |
| 2,580,437 | 1/1952 | Knoblaugh . | |
| 2,580,438 | 1/1952 | Knoblaugh . | |
| 2,843,153 | 7/1958 | Young . | |
| 2,862,283 | 12/1958 | Rasero . | |
| 2,919,219 | 12/1959 | Smith . | |
| 3,000,076 | 9/1961 | Ruton et al. . | |
| 3,110,530 | 11/1963 | Herman . | |
| 3,131,979 | 5/1964 | Shobert . | |
| 3,328,100 | 6/1967 | Spokes et al. . | |
| 3,692,375 | 9/1972 | Matt et al. . | |
| 3,765,978 | 10/1973 | Matt . | |
| 3,815,468 | 6/1974 | Matt et al. . | |
| 3,864,197 | 2/1975 | Shobert . | |
| 3,870,589 | 3/1975 | Shobert . | |
| 3,891,488 | 6/1975 | White . | |
| 3,900,408 | 8/1975 | Turner . | |
| 4,055,697 | 10/1977 | Schmanski . | |
| 4,074,512 | 2/1978 | Matt . | |
| 4,107,381 | 8/1978 | Butzow et al. . | |
| 4,263,361 | 4/1981 | Hodes . | |
| 4,320,160 | 3/1982 | Nishimura et al. . | |
| 4,407,885 | 10/1983 | Murphy et al. . | |
| 4,509,870 | 4/1985 | Taki . | |
| 4,533,321 | 8/1985 | Kidd et al. | 433/18 |
| 4,610,688 | 9/1986 | Silvestrini et al. | 623/1 |
| 4,834,755 | 5/1989 | Silvestrini et al. | 623/13 |
| 4,946,721 | 8/1990 | Kindervater et al. . | |
| 4,976,550 | 12/1990 | Shobert . | |
| 4,983,240 | 1/1991 | Orkin et al. . | |
| 4,983,433 | 1/1991 | Shirasaki . | |
| 5,052,446 | 10/1991 | Gysin . | |
| 5,061,533 | 10/1991 | Gomi et al. . | |
| 5,102,725 | 4/1992 | Knox et al. . | |
| 5,228,198 | 7/1993 | Schroeder . | |
| 5,229,177 | 7/1993 | Craven et al. . | |
| 5,320,696 | 6/1994 | McConnell et al. . | |
| 5,399,395 | 3/1995 | Forman et al. . | |
| 5,409,651 | 4/1995 | Head . | |
| 5,419,231 | 5/1995 | Earle, III . | |
| 5,576,079 | 11/1996 | Forman et al. . | |

FOREIGN PATENT DOCUMENTS

| | | |
|---|---|---|
| 245987 | 8/1963 | Australia . |
| 869221 | 5/1961 | United Kingdom . |
| WO 92/05955 | 4/1992 | WIPO . |
| WO 93/05218 | 3/1993 | WIPO . |

*Primary Examiner*—Christopher Raimund
*Attorney, Agent, or Firm*—Darby & Darby

[57] ABSTRACT

A biaxial braided sleeve braided together in a diamond braid style. The braided sleeve has an outer layer or set of thick, uncrimped strands extending in one helical direction and an inner layer or set of thick, uncrimped strands extending in the other helical direction. Much thinner containment strands hold the thick strands in position. A braided sleeve is thus provided which can have one material on the outside and a different material on the inside. For example, the inside material can be fluorocarbon polymer and the outside material can be fiberglass, providing a bearing liner. The two counter-rotating sets or layers of thick uncrimped strands provide enhanced mechanical properties.

19 Claims, 3 Drawing Sheets

BRAIDED STRUCTURE HAVING UNCRIMPED STRANDS

This application is a continuation-in-part of U.S. patent application Ser. No. 08/759,732, filed Dec. 6, 1996, pending. This application claims the benefit of Provisional Patent Application Ser. No. 60/032,230, filed Dec. 2, 1996.

FIELD OF THE INVENTION

This invention relates generally to braided structures and more particularly to a braided structure having strands which are uncrimped.

DESCRIPTION OF RELATED ART

Braided structures are well-known. Braided sleeving can be used for many applications without being incorporated into a reinforced composite, and it can also be used as the strengthening reinforcement for a fiber reinforced composite material where a matrix material, such as plastic, is reinforced by strengthening fibers.

Biaxial braiding creates a self-stable fabric which conforms to tapered, non-round, or even stepped mandrels. Braided fabric, being interlocked, has excellent integrity so distortion is minimized when the fabric is converted to a composite by methods such as Resin Transfer Molding (RTM). The interlocked fiber structure also increases out-of-plane strength and gives rise to excellent impact resistance as compared to wound or laminated composites.

However, these advantages are achieved at the expense of some in-plane stiffness and strength. The decreased in-plane stiffness and strength are due in large part to fiber undulation in the traditional braided fabric. The structural efficiency of the braided fabric is also reduced because undulation reduces the effective fiber volume fraction, especially in a triaxial braid. Furthermore, the cross-over action in the braiding process can cause damage, particularly to high modulus fibers such as graphite. The abrasive damage increases with the number of braider carriers because of the greater number of cross-overs prior to the braid convergence point.

To minimize abrasive damage during braiding, strands or fibers or filaments are often twisted. Unfortunately, the twist reduces strength and prevents the individual fibers or fiber bundles from flattening out, resulting in greater undulation of the roundish fiber bundles in the braid. If the fiber bundles were untwisted, they would more easily flatten out, resulting in greater strength and stiffness. The twist also interferes with resin impregnation into the fiber bundle; greater or complete impregnation is necessary to achieve improved shear and compression properties.

There is a need for a braided structure which has reinforcement or performance fibers or filaments having less undulation, which are uncrimped, straighter and flatter and which have less twist or no twist, yielding a structure with increased in-plane stiffness and strength and increased effective fiber volume fraction.

U.S. Pat. No. 5,419,231, the contents and drawings of which are incorporated herein by reference, addresses these concerns but provides a structure which is asymmetrically braided, having reinforcing filaments in one bias direction but not in the other.

In the conventional braided structure, such as a diamond braid (over one, under one) or a regular braid (over two, under two), each filament appears or is exposed on each side of the fabric. Thus the surface or the material forming the surface on one face of the fabric will be about the same as on the other face. However, in many applications, a two-sided braided fabric is needed; that is, the material forming the outside surface or face is different from the material forming the inside surface or face, so that different properties, such as strength and lubricity, can be provided on the different faces.

SUMMARY OF THE INVENTION

A biaxial braided sleeve comprising a plurality of first performance strands, a plurality of second performance strands, a plurality of third containment stands, and a plurality of fourth containment strands. The first, second, third and fourth strands are braided together as bias strands to form a biaxial braided sleeve, the first and third strands extend in a first helical direction, and the second and fourth strands extend in a second helical direction different from the first helical direction, the first performance strands define an outer tubular layer, the second performance strands define an inner tubular layer, and the outer tubular layer and inner tubular layer contact along a substantially smooth tubular interface. A fiber-reinforced plastic part or element comprising the invented biaxial braided sleeve in a resin matrix is also disclosed.

DETAILED DESCRIPTION OF THE PREFERRED EMBODIMENTS OF THE INVENTION

As used in the specification and claims herein, the term "strand" includes a single fiber or filament or thread as well as a bundle of fibers or filaments or threads. Each of the following, whether twisted or untwisted, is a strand: a fiber, a filament, a yarn, a tow, and a thread.

Figure 1:
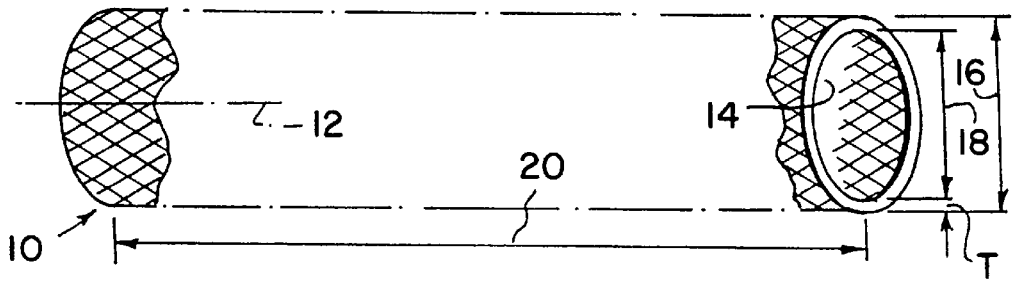
FIG. 1 is a schematic view of a biaxial braided sleeve structure according to the present invention.

With reference to FIG. 1, there is-shown schematically a biaxial braided sleeve structure 10 having a longitudinal axis 12 and a hollow interior 14. The structure 10 is biaxially braided as will be described herein. The structure 10 may optionally be used as the reinforcing for a fiber-reinforced composite structure with a resin matrix. The braided fabric structure 10 has schematically a fabric thickness T and has an outer diameter 16 and an inner diameter 18 and a length 20.

Figure 2:
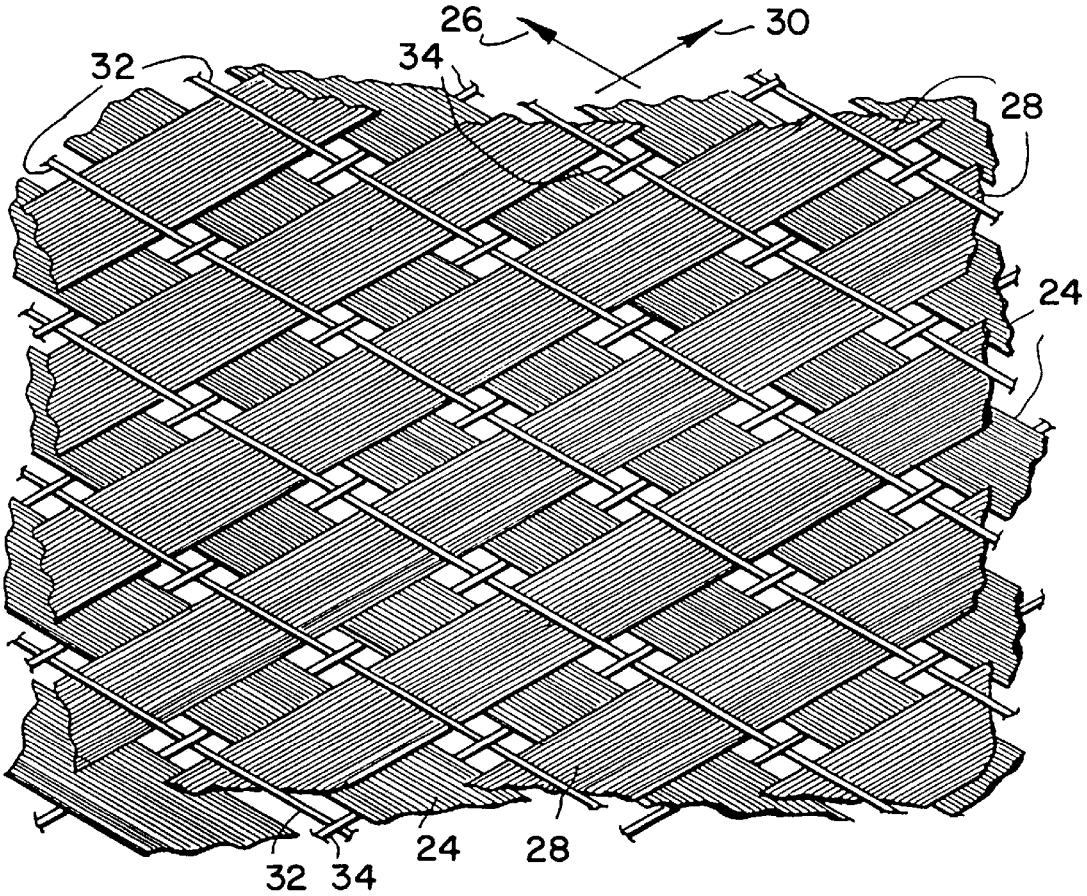
FIG. 2 is an enlarged view of a portion of the braided structure of the present invention.

With reference to FIG. 2, there is shown partially schematically an enlarged view of a portion of the braided fabric of FIG. 1; the strands 28 form the outside surface or layer of the cylindrical sleeve 10 and the strands 24 form the inside surface or layer of the sleeve 10. In FIG. 2 the strands are shown somewhat spaced apart for clarity of illustration; preferably they are closer together eliminating the air spaces shown. When the structure is considered as a whole, it can be seen that the fabric or sleeve is braided in a diamond braid (over one, under one). However, all the strands going in a single biaxial direction are not the same. The biaxially braided fabric has a plurality of first performance strands 28 and third containment strands 34 extending parallel to one another and helically in a first direction 30 and a plurality of second performance strands 24 and fourth containment strands 32 extending parallel to one another and helically in a second direction 26. The first, second, third, and fourth strands are braided together in a diamond braid style.

As shown in FIG. 2, between every two first strands 28 is a third strand 34 and between every two third strands 34 is a first strand 28, that is, they alternate. The second strands 24 and fourth strands 32 alternate in the same manner.

Figure 5:
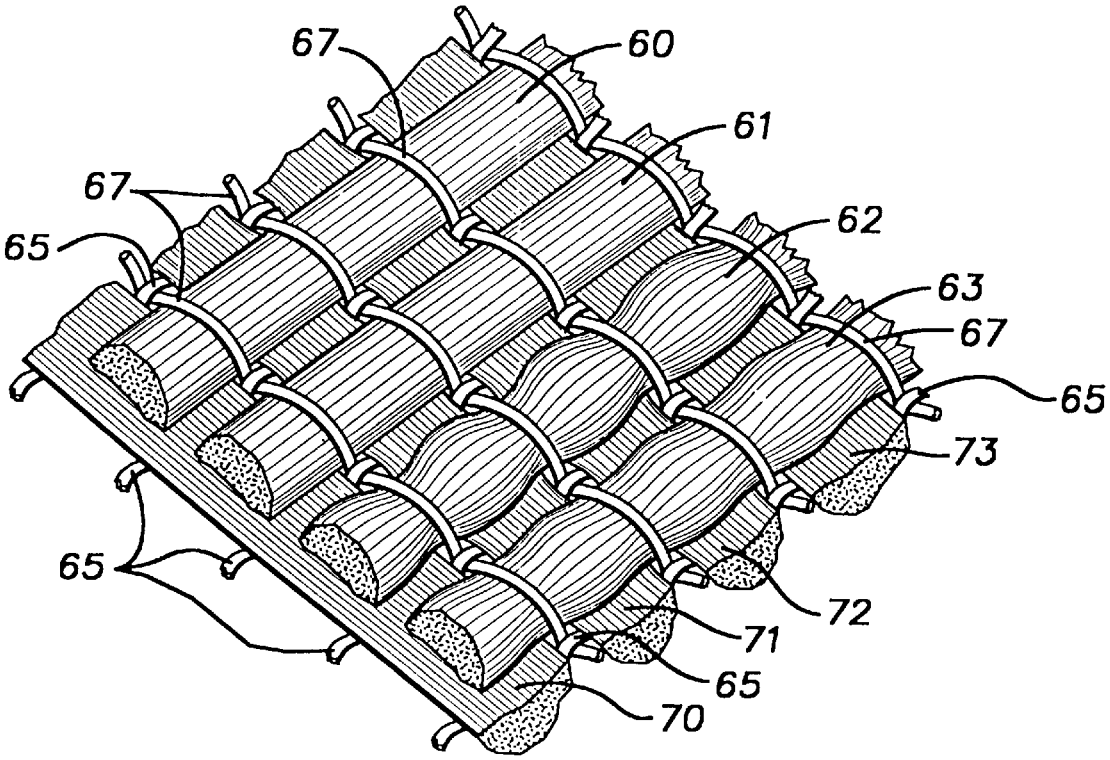
FIG. 5 is a perspective view of a portion of the biaxial braided structure or sleeve of the present invention.

FIG. 5 further illustrates in a perspective view a portion of the braided structure 10 of the present invention. First performance strands 60–63 are parallel and define, are disposed in, and form, an outer layer or outer tubular layer of the sleeve 10; second performance strands 70–73 are parallel and define, are disposed in, and form, an inner layer or inner tubular layer of the sleeve 10. As shown in FIG. 5, the outer layer and the inner layer contact each other along a substantially smooth tubular interface or interface surface; the strands 60–63 are disposed outside the interface, the strands 70–73 are disposed inside the interface. When the sleeve 10 is shaped as a hollow right circular cylinder, the outer and inner layers are concentric and cylindrical and the interface is a cylindrical surface of rotation which is smooth, substantially smooth, and planar. If the cylindrical sleeve were cut lengthwise and laid in a flat surface, the interface would be flat or substantially flat. In many applications the outer and inner layers are substantially the same thickness; these layers can be both thin and thick.

Third containment strands 65 extend parallel with one another and essentially parallel with first strands 60–63 in a first biaxial or helical direction of the braided sleeve; fourth containment strands 67 extend parallel with one another and essentially parallel with second strands 70–73 in a second biaxial or helical direction of the braided sleeve. As shown in FIG. 5, if containment strands 65 or 67 are extremely tight, they may slightly deform or depress performance strands 60–63 and 70–73 into each other. As described in the specification and claims, such a structure would still have an outer tubular layer and an inner tubular layer contacting along a substantially smooth tubular interface. As shown in FIG. 5, each of the third containment strands 65 mechanically interlocks with a plurality of the strands 67, and each of strands 67 mechanically interlocks with a plurality of the strands 65. As shown in FIG. 5, each of strands 67 is disposed substantially outside the interface, and each of strands 65 is disposed substantially inside the interface. As can be seen in FIG. 5, each of strands 60–63 and 70–73 is uncrimped; the longitudinal axis of each strand 60–63 and 70–73 does not bend as it passes over each underlying strand. Each of strands 60–63 and 70–73 is essentially or substantially straight (except for its helical curve) and does not bend out-of-plane. Each of containment strands 65 and 67 is crimped many times; the longitudinal axis of each such strand bends significantly around each performance strand it encounters and bends again at each mechanical interlock position. As known in the art, when the braided sleeve is cylindrical, the bias strands are helical. First strands 60–63 alternate with third strands 65 and second strands 70–73 alternate with fourth strands 67; the first second, third and fourth strands are braided together as bias strands to form a biaxial braided sleeve.

With further reference to FIG. 5, the first performance strands 60–63 perform a function in the braided structure. That function can be strength and stiffness in a fiber-reinforced composite; in that case the strands 60–63 are preferably fiberglass, carbon or aramid (Kevlar), less preferably ceramic, metal wire, synthetics such as acrylic, nylon, rayon, polypropylene, polyamide, and polyester, and mixtures or hybrids thereof, such as fiberglass/carbon. The fiberglass strands or tows are preferably E-glass (texturized or non-texturized) or S-glass (such as S-2 glass), as known in the art, preferably 37 to 1200 or 1800 yield, more preferably 37 to 450 yield, more preferably 112 to 450 yield, more preferably 112 or 450 yield. These are known in the art and are available from Owens Corning Fiberglass and PPG, such as PPG's 2002-827 Hybon. The carbon strands or tows are preferably 3K, 6K, 12K, 48K, and 50K, both commercial grade and aerospace grade, available from Hexcel, Toho, Toray, and Amoco, including AS4 carbon from Hexcel. The aramid strands or tows are preferably Kevlar brand from DuPont, Kevlar 29 and Kevlar 49, preferably 200 to 15,000 denier, more preferably 2000 to 15,000 denier, such as 200, 380, 1140, 1420, and 15,000 denier.

Alternatively the function of the performance strands 60–63 can be lubricity or low-friction or providing good tribological properties; in that case the strands 60–63 are preferably tetrafluoroethylene (TFE) fluorocarbon polymers, fluorinated ethylene-propylene (FEP) resins, or copolymers of TFE and FEP, generally available as Teflon brand fibers or strands from DuPont similar products from other suppliers, preferably 200–16,000 denier, more preferably 2000–16,000 denier, such as Nomex Type No. 430 Natural (200 denier). These fluorocarbon materials are also available as Halon brand strands from Allied-Signal. Less preferably other fluorocarbon polymers can be used.

Alternatively the function of the performance strands 60–63 can be electrical conductivity, preferably in a fiber-reinforced composite; in that case some or all of strands 60–63 are preferably carbon strands or tows, preferably 3K, 6K, 12K, 48K and 50K, both commercial grade and aerospace grade, available from Hexcel, Toho, Toray, and Amoco, including AS4 carbon. Alternatively metal wire strands can be used.

Hybrid performance strands can be made using more than one of the above fibers to provide multifunctionality.

With further reference to FIG. 5, the second performance strands 70–73 also perform a function in the braided structure, that function being one or more of the functions identified above for the first performance strands 60–63, utilizing the same strand material identified above for strands 60–63. Strands 60–63 and 70–73 are preferably untwisted or substantially untwisted; alternatively they may be twisted.

With further reference to FIG. 5, the third containment strands 65 and the fourth containment strands 67, which can also be referred to as scrim yarns, function to maintain the performance strands in position and are preferably strong yet as light and thin as possible. These containment strands, which can be twisted or untwisted, are preferably 10–500 denier, more preferably 200–500 denier, more preferably 500 denier, polyester or 1800–45,000 yield, more preferably 3750–20,000 yield, more preferably 3750 yield, fiberglass (preferably E-glass). Less preferably they are nylon, acrylic, rayon, UHMW polyethylene such as Spectra brand, polypropylene, polyamide or other synthetics; they can also be the same material as the performance strand they are holding in place (on the same face as the performance strand), except that the containment strand (eg, strand 67) would be much thinner or lighter than the performance strand (eg, strand 60). From this description it can be seen that the first strands 60–63 and second strands 70–73 are uncrimped or essentially uncrimped, they have little if any undulation, remain in-plane, and are essentially unbent except for their helical rotation around the cylinder.

In general the sleeve has an inside diameter (at 45° braid angle) of 0.06 to 8, more preferably 1–6, more preferably 2–5, inches. The sleeve is braided in a diamond braid style on a conventional braider having 8 to 800 or more carriers, typically having 80 to 400 or 600 carriers; how to produce a diamond braid on such a machine is known in the art. The performance strands are braided with relatively heavy tension and the containment strands with relatively light tension. If, less preferably, the performance strands and containment strands are closer in thickness or the same thickness, the crimpless features of the invention can be obtained by setting the tension on the braider very much higher for the performance strands and much less or very little or very low or not at all for the containment strands. Optionally sizing can be applied to the performance strands and not to the containment strands to make the performance strands stiffer so that they will tend to crimp or bend less during the braiding process. Some strands are relatively inflexible or brittle and do not accept crimping well. The uncrimped nature of the performance strands permits such strands to be utilized, such strands include metal wire, high modulus pitch-based carbon fibers, and ceramic fibers.

Preferably each of the performance strands 60–63 is the same material and has the same or substantially the same thickness and cross-sectional area and weight per unit length. Preferably each of the performance strands 70–73 is the same material and has the same or substantially the same thickness and cross-sectional area and weight per unit length. In many applications the performance strands 60–63 and the performance strands 70–73 are the same material and/or have the same or substantially the same thickness and cross-sectional area and weight per unit length.

Containment strands 67 are preferably the same material as performance strands 60–63 and containment strands 65 are preferably the same material as performance strands 70–73. The cross-sectional area of containment strand 67 is preferably less than ¼, more preferably less than ⅙, more preferably less than ⅛, more preferably less than 1/10, more preferably less than 1/20, more preferably less than 1/30, more preferably less than 1/40, more preferably less than 1/50, optionally less than 1/70, optionally less than 1/80, optionally less than 1/100, the cross-sectional area of each of performance strands 60–63 and performance strands 70–73. The cross-sectional area of containment strand 65 is preferably less than ¼, more preferably less than ⅙, more preferably less than ⅛, more preferably less than 1/10, more preferably less than 1/20, more preferably less than 1/30, more preferably less than 1/40, more preferably less than 1/50, optionally less than 1/70, optionally less than 1/80, optionally less than 1/100, the cross-sectional area of each of performance strands 70–73 and performance strands 60–63.

Figure 3A:
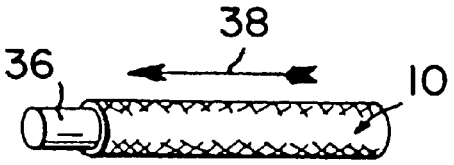
FIG. 3A is a perspective view of a braided sleeve according to the present invention being slid over a mandrel.
Figure 3B:
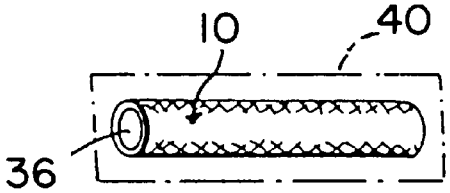
FIG. 3B is a perspective view of the braided sleeve of FIG. 3A over the mandrel being subjected to heat and pressure inside a box.
Figure 3C:
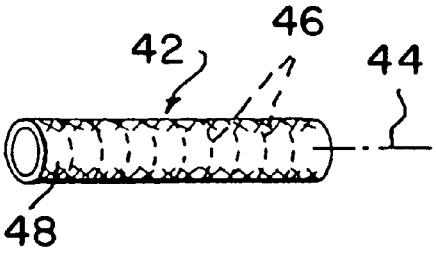
FIG. 3C is a perspective view of the finished part made as shown in FIG. 3B.

Once the invented braid is produced, it can be used as is (such as the Teflon bearing liner described infra) or impregnated with resin to form a fiber-reinforced plastic part. It can be used like other biaxial braided sleeves are currently used to make plastic parts having uniform or non-uniform or varying diameters and bends, flanges, etc. to make a multitude of different parts known in the art. The uses of such parts are known in the art. Methods to produce fiber-reinforced plastic parts are well-known in the art. With reference to FIGS. 3A–3C, the braided sleeving 10 can be impregnated with a resin (such as epoxy, polyester, vinyl ester, polyurethane, phenolic, nylon, acrylic, and other thermosets or thermoplastics) and placed over a mandrel 36 in the direction of arrow 38 or in or over a mold or substrate or base form or core and subjected to heat and/or pressure inside a chamber 40 to form or cure the resin and form the part. The processes that can be utilized include resin transfer molding (RTM) and Scrimp brand molding, hand lay-up, compression molding, pultrusion molding, "B stage" forming, and autoclave molding, all as known in the art. The resins and molding techniques that can be used to make reinforced plastic parts using the invented braided sleeving are well-known in the art and are, for example, described and referred to in U.S. Pat. Nos. 5,419,231; 5,409,651; 4,283,446; 5,100,713; 4,946,721; and 4,774,043 and the U.S. patents mentioned in those patents, the disclosures of all of which are incorporated herein by reference. FIG. 3C illustrates a fiber-reinforced plastic pipe or tube 42 after the resin is cured and the mandrel 36 is removed. Pipe 42 may be sliced perpendicular to its longitudinal axis 44 along one or more cut lines 46 to reduce the length of the pipe to make several smaller pieces 48, such as bushings.

The following (with reference to FIG. 5) are examples of sleeves according to the present invention.

1. Strands 60–63 and 70–73 are 112 yield fiberglass (E-glass) and strands 65 and 67 are 500 denier polyester or 3750 yield fiberglass. Such a sleeve can be used to form a fiber-reinforced plastic pipe or a snowboard or similar-shaped article. It can substitute for conventional braid in those applications where it is useful to eliminate the crimp.

Figure 4:
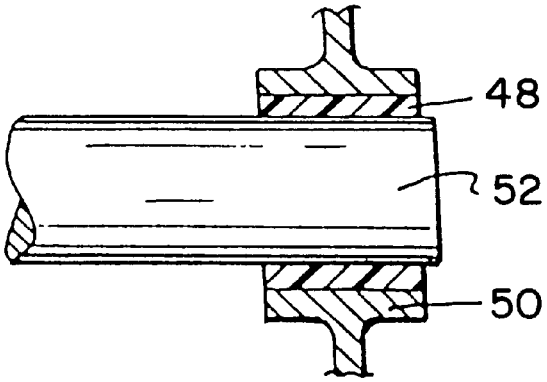
FIG. 4 is a view, partially in cross-section, of a bearing liner or bushing of the present invention being utilized.

2. Strands 60–63 are 450 yield fiberglass; strands 67 are 3750 yield (or thinner) fiberglass or 200 denier polyester; strands 70–73 are 16,000 denier Teflon (80 ends of 200 denier Teflon filaments); strands 65 are one end of 200 denier Teflon. It is noted that 16,000 denier Teflon has about the same cross sectional area as 12K carbon or 450 yield fiberglass; thus the outer face (fiberglass) is about as thick as the inner face (Teflon). Also note that the outer face (strands 60–63 and 67) is fiberglass or fiberglass/polyester while the inner face (strands 70–73 and 65) is all Teflon, thus dissimilar materials are presented on the inside and the outside of the sleeve. This sleeve (preferably ¼ inch to 3 inches in diameter) can be cut into short lengths and used as a bearing liner or bushing with Teflon on the inside and high friction/high strength material on the outside; see FIG. 4 which shows a bearing liner 48 having fiberglass on the outside and Teflon on the inside. The bearing liner 48 is mounted in and attached to housing 50. Rotary shaft 52 rotates inside the housing 50 and meets reduced friction by contacting the Teflon layer. The fiberglass outside layer has high friction, enabling it to remain more securely fastened to the inner surface of housing 50. This bearing liner or bushing can be used as described in U.S. Pat. Nos. 3,815,468; 4,040,883; 2,804,886; 2,885,248 and PCT Application number PCT/US91/07129 filed Sep. 27, 1991, published Apr. 16, 1992 as PCT International Publication Number WO92-05955, the contents of all of which are hereby incorporated by reference in their entirety.

3. Strands 60–63 are 112 or 175 yield fiberglass (texturized E-glass); strands 70–73 are 112 or 175 yield fiberglass (texturized E-glass) except that every third or fourth strand is 50K carbon or graphite; strands 65 and 67 are 500 denier polyester or 3750 yield fiberglass. The containment strands in this case constitute 0.1–10, more preferably 1–6, more preferably about 4, weight percent of the sleeve. Preferably at least half of strands 70–73 are fiberglass and at least ⅙ or ⅕ are carbon, the carbon strands being interspersed in a regular or equidistant manner among the fiberglass strands. This sleeve is made preferably 3 to 7, more preferably about 5, inches in diameter (at 45° braid angle) with the carbon strands on the inside. The finished braid is used as an intralaminar heat cure lateral liner. The pre-preg braid is used to repair conduits (eg, sewer pipes) by tubular in situ molding. Carbon or graphite strands are incorporated into the glass braid as a resistive element so that a current can be applied to produce the heat required to initiate curing the resin matrix (preferably polyester resin). The braid is impregnated with setable resin (pre-preg) and put inside a long tubular plastic bag. The bag and braid are attached to the mouth of a long pipe which needs to be repaired or relined. The bag and braid are blown in via air pressure, inverting the braid and bag and placing the carbon side of the sleeve next to the pipe. Electric current is then applied to the conductive carbon strands, which warm and heat up by electrical resistance heating. Air pressure holds the assembly against the pipe and the heat cures the resin. The cured resin then cools and the pipe is thus repaired or relined.

4. For a golf club shaft a sleeve is made such that it can have an 0.06 (less preferably 0.04–0.1) inch inside diameter at the tip and an 0.33 (less preferably 0.2–0.5) inch inside diameter at the butt end of the shaft. Strands 60–63 are 12K carbon, less preferably 3K or 6K carbon; strands 70–73 are preferably 12K carbon, alternatively 3K or 6K carbon; the outer layer (strands 60–63) are preferably made heavier or stronger. For a right-handed player the outer layer is braided so that the strands 60–63 run or extend in the clockwise direction (viewed from above looking down the longitudinal axis of a sleeve, the strands at the 12 o'clock position travel down and toward the 3 o'clock position); for a left-handed player strands 60–63 run or extend in the other direction; this provides for improved strength and stiffness when the club head strikes the golf ball. The strands 65 and 67 are 1K (less preferably 0.3–2.5K) carbon or 420 (less preferably 100–800) denier black nylon. The braid is impregnated with resin and molded into a golf club shaft as known in the art.

5. A sleeve for a tennis racket body can be made. The performance strands are a carbon/nylon hybrid; the containment strands are nylon. A bladder is placed inside the sleeve and blown up to press the sleeve against a mold. The mold is heated and the nylon melts and then cools to form a rigid sleeve for the handle or body.

As can be seen, the invented braid effectively debulks those reinforcement strands which are bulky. In a regular braid, big reinforcement strands are not restrained as much and tend to bulk up. Here, those strands are restrained and held flat by a large number of containment strands; a lot of fiber is kept in a thin space. This permits such things as an integral flange to be made on a thick fiber-reinforced plastic pipe. Two or three ends of 112 yield fiberglass per carrier are used to make the sleeving, which is used to make a strong flange on a big pipe. Thick waterfront pilings can be made in the same way.

Although the preferred embodiments have been described, it is understood that various modifications and replacements of the components and methods may be resorted to without departing from the scope of the invention as disclosed and claimed herein.

What is claimed is:

1. A biaxial braided sleeve comprising:

a plurality of first performance strands, a plurality of second performance strands, a plurality of third containment strands, and a plurality of fourth containment strands, said first, second, third and fourth strands being braided together as bias strands to form a biaxial braided sleeve, said first and third strands extending in a first helical direction, said second and fourth strands extending in a second helical direction different from said first helical direction, said first performance strands defining an outer tubular layer, said second performance strands defining an inner tubular layer, said outer tubular layer, said inner tubular layer contacting along a substantially smooth tubular interface;

said first strands being disposed outside said interface, said second strands being disposed inside said interface, said first and third strands alternating with one another, said second and fourth strands alternating with one another;

each of said third containment strands mechanically interlocking with a plurality of said fourth containment strands, each of said fourth containment strand, mechanically interlocking with a plurality of said third containment strands; and each of said fourth containing strands being disposed substantially outside said tubular interface and each of said third containment strands being disposed substantially inside said tubular interface.

2. A braided sleeve according to claim 1, said first strands and said second strands being uncrimped, said third strands and said fourth strands being crimped.

3. A braided sleeve according to claim 1, each of said fourth containment strands having a cross-sectional area less than one-fourth the cross-sectional area of each of said first performance strands, each of said third containment strands having a cross-sectional area less than one-fourth the cross-sectional area of each of said second performance strands.

4. A braided sleeve according to claim 3, each of said fourth containment strands having a cross-sectional area less than one-thirtieth (1/30) the cross-sectional area of each of said first performance strands, each of said third containment strands having a cross-sectional area less than one-thirtieth (1/30) the cross-sectional area of each of said second performance strands.

5. A braided sleeve according to claim 3, said first strands being a first material, said second strands being a second material, said first material being a different material from said second material.

6. A braided sleeve according to claim 5, said first strands being fiberglass, said second strands being a fluorocarbon polymer.

7. A braided sleeve according to claim 6, each of said third containment strands being a fluorocarbon polymer and having a cross-sectional area less than one-thirtieth (1/30) the cross-sectional area of each of said second performance strands.

8. A braided sleeve according to claim 3, each of said first performance strands and each of said second performance strands being a material selected from the group consisting of fiberglass, carbon, and aramid.

9. A braided sleeve according to claim 8, each of said first performance strands and each of said second performance strands being fiberglass.

10. A braided sleeve according to claim 9, each of said fourth containment strands having a cross-sectional area less than one-twentieth (1/20) the cross-sectional area of each of said first performance strands, each of said third containment strands having a cross-sectional area less than one-twentieth (1/20) the cross-sectional area of each of said second performance strands.

11. A braided sleeve according to claim 3, each of said first performance strands being fiberglass, at least half of said second performance strands being fiberglass, at least one-sixth (1/6) of said second performance strands being carbon, said carbon second performance strands being interspersed among said fiberglass second performance strands.

12. A braided sleeve according to claim 8, each of said first performance strands and each of said second performance strands being carbon.

13. A braided sleeve according to claim 12, said first performance strands extending in the clockwise direction.

14. A braided sleeve according to claim 3, each of said first performance strands and each of said second performance strands being a carbon/nylon hybrid, each of said third containment strands and each of said fourth containment strands being nylon.

15. A braided sleeve according to claim 3, each of said fourth containment strands having a cross-sectional area less than one-twentieth (1/20) the cross-sectional area of each of said first performance strands, each of said third containment strands having a cross-sectional area less than one-twentieth (1/20) the cross-sectional area of each of said second performance strands.

16. A braided sleeve according to claim 1, each of said fourth containment strands having a cross-sectional area less than one-twentieth (1/20) the cross-sectional area of each of said first performance strands, each of said third containment strands having a cross sectional area less than one-twentieth (1/20) the cross-sectional area of each of said second performance strands.

17. A braided sleeve according to claim 16, each of said fourth containment strands having a cross-sectional area less than one-thirtieth (1/30) the cross-sectional area of each of said first performance strands, each of said third containment strands having a cross-sectional area less than one-thirtieth (1/30) the cross-sectional area of each of said second performance strands.

18. A braided sleeve according to claim 17, each of said fourth containment strands having a cross-sectional area less than one-fortieth (1/40) the cross-sectional area of each of said first performance strands, each of said third containment strands having a cross-sectional area less than one-fortieth (1/40) the cross-sectional area of each of said second performance strands.

19. A fiber-reinforced plastic element comprising a biaxial braided sleeve in a resin matrix, said sleeve comprising a plurality of first performance strands, a plurality of second performance strands, a plurality of third containment strands, and a plurality of fourth containment strands, said first, second, third and fourth strands being braided together as bias strands to form a biaxial braided sleeve, said first and third strands extending in a first helical direction, said second and fourth strands extending in a second helical direction different from said first helical direction, said first performance strands defining an outer tubular layer, said second performance strands defining an inner tubular layer, said outer tubular layer and said inner tubular layer contacting along a substantially smooth tubular interface;

said first strands being disposed outside said interface, said second strands being disposed inside said interface, said first and third strands alternating with one another, said second and fourth strands alternating with one another;

each of said third containment strands mechanically interlocking with a plurality of said fourth containment strands, each of said fourth containment strands mechanically interlocking with a plurality of said third containment strands; and each of said fourth containing strands being disposed substantially outside said tubular interface and each of said third containment strands being disposed substantially inside said tubular interface.

* * * * *